US005106489A

United States Patent [19]

Schmidt et al.

[11] Patent Number: 5,106,489

[45] Date of Patent: Apr. 21, 1992

[54] ZIRCON-RUTILE-ILMENITE FROTH FLOTATION PROCESS

[75] Inventors: Roland Schmidt, Lakewood; Dale L. Denham, Jr., Louisville, both of Colo.

[73] Assignee: Sierra Rutile Limited, Santa Rosa, Calif.

[21] Appl. No.: 742,604

[22] Filed: Aug. 8, 1991

[51] Int. Cl.[5] ..... B03D 1/016; B03D 1/018; B03D 1/02; B03D 1/08

[52] U.S. Cl. ..... 209/166; 209/167; 209/17; 209/10

[58] Field of Search ..... 209/13, 17, 18, 164, 209/166, 167, 10; 423/73, 80, 81; 252/61

[56] References Cited

U.S. PATENT DOCUMENTS

| | | | |
|---|---|---|---|
| 2,387,856 | 10/1945 | Pickens | 209/166 |
| 2,557,455 | 6/1951 | Moyer | 209/166 |
| 2,610,738 | 9/1952 | Cuthbertson | 209/167 |
| 2,665,004 | 1/1954 | Zukosky | 209/166 |
| 2,792,940 | 5/1957 | Baarson | 209/166 |
| 2,904,177 | 9/1959 | Michal | 209/166 |
| 3,097,162 | 7/1963 | Baarson | 209/166 |
| 3,117,924 | 1/1964 | Baarson | 209/166 |
| 3,480,143 | 11/1969 | Mitzmager | 209/166 |
| 3,482,688 | 12/1969 | Bushell et al. | 209/166 |
| 4,214,710 | 7/1980 | Wilson | 241/24 |
| 4,261,846 | 4/1981 | Wilson | 252/61 |
| 4,339,331 | 7/1982 | Lim | 209/167 |
| 4,362,615 | 12/1982 | Llewellyn et al. | 209/167 |
| 4,437,983 | 3/1984 | Petrovich | 209/166 |

FOREIGN PATENT DOCUMENTS

| | | | |
|---|---|---|---|
| 14780 | 10/1933 | Australia | 209/166 |
| 542775 | 6/1957 | Canada | 209/166 |
| 406018 | 2/1934 | United Kingdom | 209/166 |
| 406043 | 2/1934 | United Kingdom | 209/166 |

*Primary Examiner*—Stanley S. Silverman
*Assistant Examiner*—Thomas M. Lithgow
*Attorney, Agent, or Firm*—Darby & Darby

[57] ABSTRACT

This invention relates to a method for recovering a bulk concentrate of zircon and a bulk concentrate of rutile-ilmenite from dry plant tailings. A process has been discovered for froth flotation by manipulating the surface charges of dry plant tailings. Conditioning reagents, sulfuric acid to lower the pH; corn starch to coat the minerals to be depressed; sodium fluoride to activate the minerals to be floated; and amine to float the activated minerals, are used in the flotation process.

14 Claims, 1 Drawing Sheet

ZIRCON-RUTILE-ILMENITE FROTH FLOTATION PROCESS

BACKGROUND OF THE INVENTION

This invention relates, in general, to the separation of dry plant tailings into two bulk concentrates. More specifically, it relates to a froth flotation method for the separation of a bulk concentrate which comprises zircon from another bulk concentrate which comprises rutile and ilmenite.

Conventional flotation processes have been used to separate minerals such as copper, molybdenum, zinc, iron, tungsten, and kyanite from waste and other minerals. The minerals are separated by generating air bubbles which selectively attach to the mineral or minerals to be floated. The proper conditions must be present in the flotation process to permit attachment of the mineral to the bubbles. The air bubbles, together with the attached group, rise to the surface to form a froth which is removed. However, if the weight of the particles is too high or the forces of attachment are too weak, the minerals will drop from the bubbles and the minerals will not become part of the froth. Therefore, the weight of the particles must be low enough and the forces of attachment strong enough to permit the bubbles to rise while carrying the mineral with it.

It is known in froth flotation technology to use anionic-type promoters to provide proper conditions for the attachment of minerals to air bubbles. For example, an anionic-type promoter has been used to condition phosphorus-bearing minerals for attachment to air bubbles. See, for instance, U.S. Pat. Nos. 2,557,455 and 3,482,688. It is also known to use depressants in froth flotation processes for depressing the minerals which form the sink product. For example, U.S. Pat. No. 2,497,863 is directed to subjecting pulp to a processed starch product to depress the minerals in the pulp.

In the conventional froth flotation systems, silicates are separated from the titanium values. Titanium values are present in ilmenite and rutile. Ilmenite is a compound of ferrous oxide and titanium dioxide and rutile is a compound of titanium dioxide. After the separation of the titanium values, the titanium values are retained as the desired product and the silicates are discarded.

In U.S. Pat. No. 2,904,177 a flotation method is used for the removal of silicates from an ilmenite ore. The silicates present in the ilmenite ore are garnet, feldspar, hornblende and augite. The silicates are removed by grinding the ore to −60 mesh size; preparing an aqueous pulp with the ground ore; acidifying the pulp with hydrofluoric acid; adding starch to the pulp to depress the titanium values present in the ilmenite ore; adding to the pulp a cationic amine flotation agent; and subjecting the treated pulp to a froth flotation. According to this patent, the titanium values form the desired product and the silicates are discarded. In this patent, the pH is lowered before subjecting the treated pulp to froth flotation to remove the feldspars and other silicates. Although this method has been used to recover titanium values, this conventional process has not been used to recover a zircon float product from a rutile/ilmenite sink product.

It has now been found that zircon, a valuable mineral, can be effectively recovered from tailings by means of froth flotation. In the present invention, dry plant tailings are used which comprise zircon, aluminum minerals, quartz, ilmenite and rutile from which tailings the zircon and the rutile/ilmenite can be recovered. Thus, in the present invention both the zircon bulk concentrate and rutile/ilmenite bulk concentrate are recovered as final products and are further cleaned as required by dry processing to marketable grade products.

It is an advantage of the present invention that high concentrations of two desired bulk products can be recovered from dry plant tailings. Other advantages of the present invention are that the flotation process provides a means for recovering fine titanium and zircon values that are not efficiently recovered by conventional dry processing. Further, since these plant tailings are rejects from the conventional dry processing, it is likely that treating them again by the same dry methods would be inefficient, and hence a new process is required to allow the tailing to be recovered. It has been determined that it is advantageous to separate two bulk products in a froth flotation process by manipulating the surface charges on the minerals of the dry plant tailings.

SUMMARY OF THE INVENTION

This invention is directed to a method for recovering a bulk concentrate of zircon and a bulk concentrate of rutile/-ilmenite from dry plant tailings. More specifically, the invention is directed to a froth flotation process which manipulates the surface charges of dry plant tailings with conditioning reagents: acid to lower the pH; starch to coat the minerals to be depressed; fluoride ions to activate the mineral to be floated; and a cationic amine collector to float the activated mineral.

DETAILED DESCRIPTION OF THE INVENTION

Figure 1:
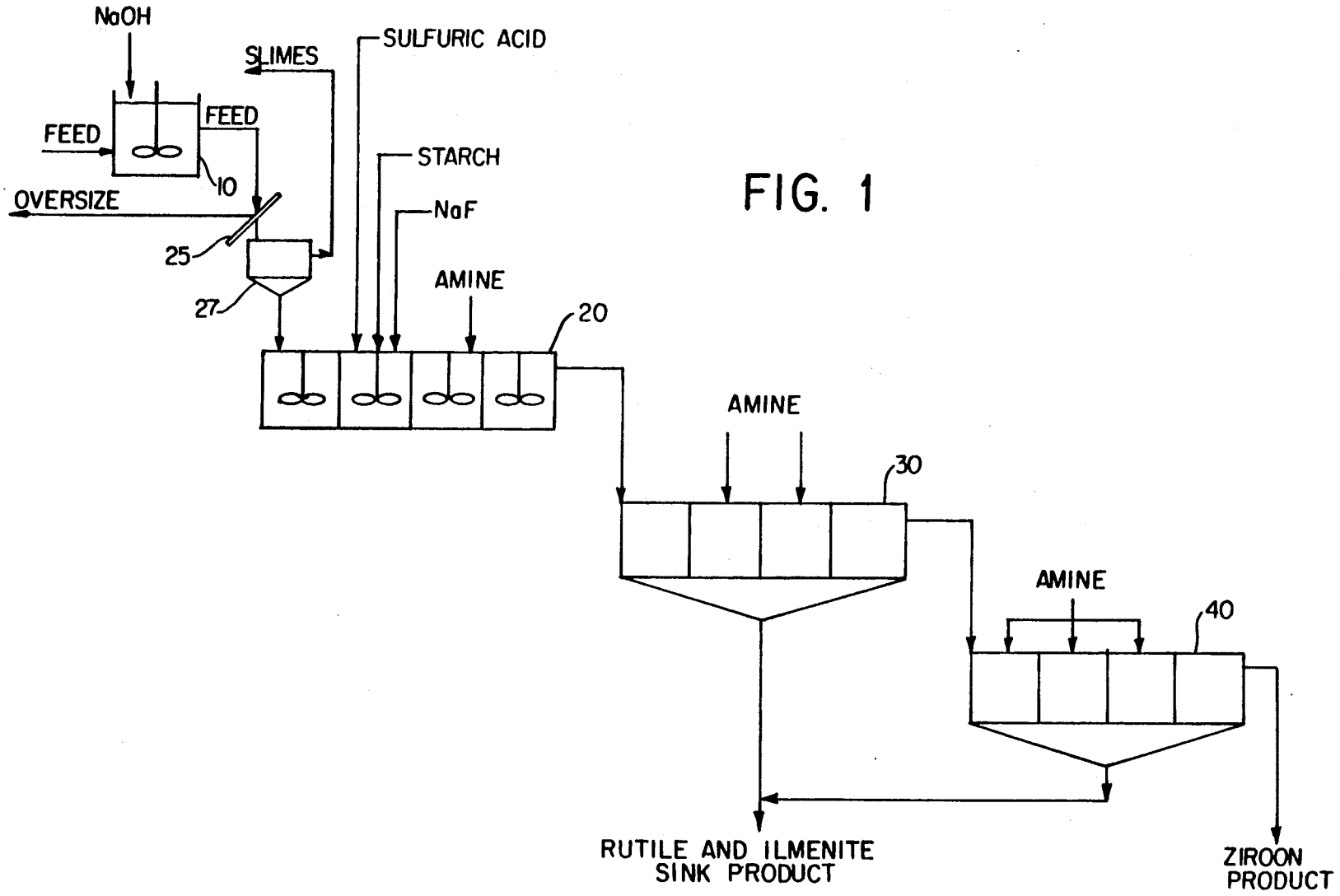
FIG. 1 is a flow diagram of the process according to the present invention.

It has now been discovered that a product of zircon or zircon and aluminum minerals can be separated from a sink product of rutile and ilmenite by flotation. In the process, the surface of the float product is made electronegative at low pH and, hence, ready to accept a cationic (positive) amine collector. It is known that at very low pH values minerals such as zircon, garnet, sillimanite, kyanite and corundum will have surfaces that have a net positive charge. Therefore, if a cationic collector having a positive charge is added to the minerals there will be no electrostatic attraction between the two positive charges. However, it has been proposed that the addition of a fluoride ion or a fluorosilicate complex to the mineral to be floated at low pH will render the surface of the mineral negative and it will then be capable of accepting a cationic amine collector. The precise mechanism for activation of these silicates is uncertain.

FIG. 1 illustrates the basic concept of the froth flotation flow process of this invention. A scrubber 10 receives the flotation feed prior to flotation. NaOH is added to the scrubber 10 for removing coatings on the minerals of the feed, such as slimes. The feed from the scrubber 10 is transferred to the screens 25 for removing minerals too coarse for the flotation process. The screen undersize product can be made denser in a hydrocyclone 27 prior to conditioning. The hydrocyclone can also remove the slimes released from the minerals in the scrubber 10. The screen oversize product can be further upgraded and the slimes from the hydrocyclones 27 can be discarded. The feed from the hydrocyclones 27 is transferred to the conditioners 20. Sulfuric acid, starch, NaF, and amine are added in the conditioners 20. After the conditioners 20, the conditioned flotation feed is transferred to rougher flotation cells 30 for separating the flotation feed into the zircon float product and the rutile and ilmenite sink product. Amine is added during flotation in the rougher flotation cells 30. The zircon float product is transferred to cleaner cells 40. Amine is added in the cleaner cells 40 as required. The cleaner cells 40 separate the zircon float product from the cleaner rutile and ilmenite sink product. The rutile and ilmenite sink product from the cleaner cells 40 is combined with the rutile and ilmenite sink product from the flotation cells 30 or it is returned to join the feed to the rougher cells.

It is desirable in the flotation process that zircon be removed as the float product from an ilmenite/rutile sink product. It is also desirable that the aluminum minerals in the tailings are removed from the ilmenite/rutile sink product. Examples of such aluminum minerals are garnet, $Fe_3Al_2(SiO_4)_3$, $Ca_3Al_2(SiO_4)_3$, kyanite ($Al_2O_3$.-$SiO_2$) and corundum ($Al_2O_3$). The aluminum minerals are floated from the sink product, in a similar manner to floating the zircon, by manipulating the charges on the mineral surfaces.

In carrying out the process of the present invention, the feed is either size classified to remove the coarse fraction of the feed or is ground to a particle size which is small enough to allow the desired mineral to be floated by air bubbles. Preferably, the feed is ground or size classified to a particle size of about −80 mesh. Exemplary of the minerals which can be present in such tailings are rutile, ilmenite, quartz, garnet, iron oxides, zircon, corundum, sillimanite and kyanite. While the preferred feed materials in the process of the invention are dry plant tailings, the process also applies to materials of the same minerals, such as an ore, or to minerals other than those from a dry plant.

It may be necessary to process the dry plant tailings ahead of flotation in order to make the material more suitable for flotation. For example, the dry plant tailings can be first upgraded by a spiral gravity circuit to remove some of the low gravity quartz prior to flotation. In some cases, there may not be enough quartz present in the feed to warrant a separate gravity circuit ahead of the flotation. Other treatments as are known in the art can also be used to remove specific minerals ahead of the flotation, if economically favorable.

Conditioning and subsequent flotation can be carried out in any conventional cell suitable for froth flotation at ambient temperature, e.g., a range of about 5° C. to about 40° C., and at atmospheric pressure. Conditioning agents comprise a scrubbing agent, a pH modifier, a depressant, an activator and a collector.

The tailings can be scrubbed prior to flotation with sulfuric acid, hydrochloric acid or sodium hydroxide. The scrubbing removes coatings on the minerals which would inhibit separation of the minerals during the flotation process. It has been determined that sodium hydroxide is advantageous for removing coatings and is economically preferable.

Sulfuric acid is the preferred pH modifier to lower the pH as required. Preferably, the pH is lowered to a value between about 2.0 and 6.0 for flotation of zircon. Most preferably, the pH is lowered to a pH value of between 2.0 and 3.0 for flotation of the aluminum minerals (i.e., garnet, kyanite sillimanite and corundum) and zircon, present in the tailings, away from the titanium oxides. The zircon and other silicates are the desired float products.

The quantity of sulfuric acid used depends on the desired pH and the presence of acid-consuming minerals; generally, about 1–10 lbs of sulfuric acid per ton of feed to the flotation cells are used. Sulfuric acid has the advantages of low cost and less corrosivity to equipment than other acids. Also, concentrated sulfuric acid can be used to lower the pH value without substantially increasing the volume of the feed. Examples of other acids which can be used as pH modifiers are hydrochloric, hydrofluoric and nitric acid. However, hydrofluoric acid at a pH of less than 2.5 may undesirably activate the titanium oxides.

Fluoride is used in various forms, such as NaF, $Na_2SiF_6$ and HF, to provide fluoride ions for changing the surface charge of the minerals to be floated. Thus, fluoride activates the minerals to be floated such that the surface of the minerals acquires a net negative charge. The fluoride ions, F—, or fluorosilicate complex, $SiF_6^{2-}$, is attracted to the positively charged surface to be floated such that a negative surface is produced. During conditioning at low pH some of the NaF and $Na_2SiF_6$ may be converted to HF. If HF is formed, the HF has an active role in scrubbing the minerals. The scrubbing of the minerals produces clean surfaces which help the attachment of activators, depressants and amine collectors to the mineral surfaces. The addition of high levels of NaF at low pH can generate slimes, which can be due to the attacking (or scrubbing) of the ilmenite and other minerals. Preferably, NaF is used at about 2.0 lbs per ton of rougher flotation feed. The amount of sodium fluoride added can be extended from about 2.0 lbs per ton flotation feed to about 5.0 lbs per ton of flotation feed depending upon the amounts of silicate minerals present in the feed and the concentration of other chemicals in the flotation water. As the amount of sodium fluoride is decreased, the froth becomes darker, indicating that more ilmenite and rutile are being floated instead of forming the desired sink product. Since the fluoride ion is negative, if added in excess, it can neutralize positive collector ions and, hence, interfere with flotation. The amount of NaF required will increase or decrease with the amount and size of the silicates that are present.

Starch is added to the pulp to depress the minerals which form the sink product. Starch has been used in conventional systems for the depression of iron oxides. However, the possibility exists that starch, as an anionic (−) molecule, could react with the cationic (+) collectors and neutralize the collector without allowing the collector to attach to the surface of the mineral. It has been determined that starch can be used with sodium fluoride without conflicting with the activation of the products to be floated or the attachment of the cationic collector to the activated mineral surfaces. It has been determined that the starch and the cationic collector do not conflict with each other to the extent that flotation is noticeably affected because the titanium oxides remain positively charged at a pH range of about 2.0–6.0. It is known that titanium oxides are positively charged because of having a high point of zero charge (PZC). For example, the PZC of rutile is about 6.7 and the PZC of ilmenite is about 6.5. The positively charged titanium oxides selectively absorb the negatively charged starch to prevent absorption of the collector on the titanium oxides and, hence, cause depression of the oxides. It has also been determined that starch and sodium fluoride do not compete for the same mineral surfaces, that is, the starch interacts with the titanium minerals and slimes and not with the silicates. The NaF interacts with the silicates and does not interact to any noticeable degree with the titanium minerals.

Preferably, corn starch, consisting of polymers of dextrose, is used as the depressant for rutile, ilmenite and quartz. Many industrial corn starch products can be used as a depressant for titanium minerals and to control slimes, as are known in the art. As an example of the starch, it is possible to use a starch sold under the tradename Corn Products Starch 3005 by the Corn Products International Company. The carboxylate group of the starch provides the negative charges on the starch molecule. The starch is a dry, fine grained powder and is slightly acidic when dispersed in water. A 2.5% solution becomes slightly viscous and opalescent upon heating. Concentrated solutions of the starch become very viscous and difficult to work with.

To develop the adhesive properties of the starch, the starch is dispersed in water to form a slurry. The slurry is heated, preferably to a boiling temperature, to disrupt bonding of the starch molecules. The amount of starch used in the process is dependent on the quantity of titanium oxides in the feed, the quantity of amine collector used, the amount of slimes present and the pH value. It is desired that the quantity of starch is balanced with the feed composition, size of particles in the feed and amount of reagents so that the titanium oxides are sufficiently depressed. It is also desired that the starch be added in a sufficient amount but not be added in excess. The addition of excess starch can depress zircon and other minerals which are to be floated. The addition of starch controls slimes, which can be present in the flotation cell, by flocculating the slimes. At low pH slimes have a positive charge and the negative starch adheres to the slimes so that flocculation will occur. Flocculation of the slimes gathers the slimes together so that the slimes are not attracted to the mineral surfaces. Excess starch could neutralize the amine collector and require the use of more amine than is normally necessary. For example, it has been determined that if starch is added in excess, the flotation of zircon and other minerals to be floated can be diminished completely due to the neutralization of the cationic collector with the anionic starch, since neutralization of the collector can result in consumption of the cationic collector. It is, therefore, preferable to balance the amount of starch used with the feed composition and the amount of reagents used. For example, the quantity of starch used can range from about 0.5 to about 10.0 lbs/ton of flotation feed.

If quartz is present in the feed, the quartz can be depressed by the addition of starch. The starch preferentially coats the rutile and the ilmenite and the excess starch coats the quartz. If it is desired that the quartz be depressed, starch in excess of the amount to depress the rutile/ilmenite and control slimes can be added. Alternatively, if it is desired that the quartz be floated, then less starch is used in the flotation.

A collector is used to float the desired minerals. Specifically, a collector is adsorbed on the surface of the mineral to be floated to make the particles hydrophobic (water repellent) which promotes adherence to the air bubbles present in the flotation cells.

The amine collector which is used is a fatty amine. Preferably, the amine collector is a coco amine having the formula $RNH_2$, where R is $C_6$–$C_{18}$ with 55% $C_{12}$ having a molecular weight of about 203. The salts and derivatives of the coco amine can also be used. The primary coco amines are produced from a coconut fatty acid by a reaction with ammonia. The coco amines are weak bases, and are soluble in common organic solvents, but are insoluble in water. The salts are prepared by reacting the amines with acetic acid and are water dispersible. The primary amines are in a liquid form at 25° C. Coco primary amines are readily available in the marketplace. For example, coco primary amines are sold by Sherex Chemical and Akzo Chemicals. Arosurf MG-160, manufactured by Sherex Chemical, and Armac C, manufactured by Akzo Chemicals, are examples of coco amine derivatives which can be used as an amine collector. Armac C is a corrosive paste with a slightly acetic acid odor. Armac C has a melting point of about 50° C. and it decomposes on extended heating. The decomposition rate of Armac C increases with increasing temperature.

Primary amines can be prepared or mixed in several ways prior to adding these amines to the flotation conditioners and flotation cells. There are advantages and disadvantages to each method of preparation and the method selected depends on many factors which are peculiar to the flotation circuit. However, each method of preparation will result in flotation. For example, the primary coco amine can be added as a free base, the amine can be neutralized about 50% with acetic acid and made up to about a 4.0% solution in water, and the amine can be mixed with water, neutralized and a frother added. Other methods for preparing the primary amines are also known in the art.

Preferably, the pH modifier is added first, followed by the starch, the fluoride, and the cationic amine collector. The starch, sodium fluoride and pH modifier can be added and conditioned in any order before the addition of the cationic amine collector, but if the preferred order is not used the results may not be optimal. The pH modifier, starch, fluoride and cationic amine collector are all added and conditioned before the flotation begins in the flotation cells. These flotation cells can be described as a rougher flotation, which flotation produces a zircon froth product and an ilmenite/rutile sink product. It is preferred, but not required, that the amine be conditioned separately in its own conditioner. The initial addition of amine can be added to the feed in the first flotation cell, or added just ahead of the first flotation cell, rather than being added to the feed in a special conditioner cell. After the flotation begins, an additional amount of the starch depressant can be added based on the color of the froth observed during the flotation process. For example, if the froth becomes black in color then ilmenite and rutile are being pulled into the froth and an additional amount of starch can be added to depress the ilmenite and rutile. Also, after the flotation begins, cationic amine collector can be added as necessary in several stages depending on an analysis of the froth observed during the flotation process. If the froth is not mineralized, then more amine is needed. When the reagents are in balance, the froth has a brown color (from the zircon) or a pink color (if considerable garnet is present). The cationic amine collector addition rate can also be automatically controlled to increase recovery of the zircon.

The zircon froth product can be subjected to a second flotation, described as a cleaner flotation, for upgrading the zircon froth product. In the cleaner flotation, the zircon froth product from the rougher flotation is moved to another set of cells called cleaner cells, the pH is held in the same range as used in the rougher flotation, and the amine, if used, is added at about 0.05 to 0.30 lbs per ton of feed to the rougher cells. The cleaner stage can be used to drop out unwanted ilmenite and rutile from the froth product into the sink product, where it can be discarded or sent back to the rougher cell feed. If the cleaner feed is fully reagentized it may not be necessary to add more amine, starch or sodium fluoride to the cleaner cells.

If sufficient quartz is in the rougher sink product, that product can be taken to another flotation cell where a cationic silica flotation is carried out at about pH 10. Sodium hydroxide is added in sufficient quantity to raise the pH and amine is added in sufficient amount to float the quartz. Normally, no additional starch is required to keep the ilmenite and rutile depressed. The quartz float product is discarded and the sink product is a rough concentrate of rutile and ilmenite.

Lime may be added prior to the tailings disposal to neutralize excess sulfuric acid and flocculate slimes produced in the flotation system.

In an embodiment of the present invention, NaOH is used to increase the pH after flotation so that the quartz that was depressed by the starch can be floated away from the titanium oxides. The product produced after removal of the quartz is a high grade titanium oxide product. The sodium hydroxide also cleans the mineral surfaces to free the surfaces of slimes by providing $OH^-$ to the slimes which become electronegative and, hence, are dispersed. For example, the quantity of NaOH used is about 1.0 lb/ton of feed.

Bentonite clay is used to remove the amine from the float product, to render the zircon suitable for subsequent processing. Bentonite has a very high negative charge. Therefore, bentonite has a high affinity for a positively charged amine. If bentonite is added to the flotation concentrate and conditioned, the bonds between the positive amine and the zircon are broken and new bonds are formed between the positive amine and the bentonite. Thereafter, the bentonite, with the attached amine, can be removed from the float product by desliming in a unit operation such as cycloning. Bentonite is composed of the clay mineral montmorillonite ($(Na,Ca)_{0.33}(Al,Mg)_2Si_4O_{10}(OH)_2 \cdot nH_2O$). Bentonite can be added at about 2.0 to about 5.0 lbs/ton of zircon flotation product.

In order to illustrate the process of the present invention, the following examples are presented:

EXAMPLE 1

A composition of 20.4% $ZrO_2$, (about 30% zircon) and 38.3% $TiO_2$ (about 21% ilmenite and 27% rutile), with the remainder of the composition consisting of quartz (about 10%), garnet (about 9%), minor constituents of kyanite, sillimanite, corundum and iron oxide (about 3%) was scrubbed with 1.0 lbs/ton NaOH at 82% solids in a rubber-lined, four compartment (1 cubic ft. each), Denver attrition scrubber. Retention time was 9–11 minutes and throughput was 1400 lbs/hr. The scrubbed sample was wet screened at 80 and 325 mesh on Derrick and Sweco screens, respectively. This composition forms the conditioned feed shown in FIG. 1. $H_2SO_4$ was added at 3.0 lbs/ton feed to obtain a pH value of 2.7. The 80×325 mesh product was conditioned with 1.0 lbs/ton feed of a 2.5% solution of boiled corn starch. A 3.0% solution of NaF was added at 2.0 lbs/ton feed at 50% solids. Arosurf 160 was added as a cationic amine collector at 0.1 lbs/ton feed.

The starch, $H_2SO_4$, NaF and amine were added to the scrubbed sample by transferring the sample to a first set of four plexiglass conditioning cells and adding the reagents to the cells. Retention time was two minutes per cell.

The conditioned feed was diluted to 35% to 40% solids and floated in rougher cells. The feed rate was 220 lbs/hour to this set of cells to give a retention time in the cells of about six minutes. Amine was added to the second and third of four rougher cells at 0.06 lbs/ton of rougher feed. The rougher concentrate was diluted to about 20% solids in a launder.

The float product from the rougher cells was transferred to cleaner cells. In the cleaner cells, the float product was cleaned. Additional amine was added to a first, second and third cleaner cell of four cleaner cells at a rate of 0.03 lbs/ton feed. There was a retention time of about 12 minutes in the cleaner flotation.

The cleaned zircon flotation product shown in FIG. 1 assayed 47.7% $ZrO_2$ and 2.13% $TiO_2$ which is 89.3% of the $ZrO_2$ and 2.0% of the $TiO_2$ in the feed. If the rougher and first cleaner tailings are combined, recovery is 98.0% of the $TiO_2$ in the feed and the product assayed 59.2% $TiO_2$. The major contaminants are quartz and garnet. The garnet is readily activated and most is pulled into the final froth product with zircon since it is activated in a similar manner. The quartz tends to distribute itself such that most of the coarse quartz sinks into the ilmenite/rutile product and some of the finer quartz floats with the zircon. The combined product also contains 3.2% $ZrO_2$ which is 10.7% of the $ZrO_2$ in the feed.

EXAMPLE 2

A three stage locked cycle flotation scheme was used having a zircon rougher flotation at low pH, a zircon cleaner flotation at low pH and a quartz flotation from the rougher sink product at high pH. About 500 grams of a composition having zircon 31.7%, other silicates 11.1%, rutile 33.9%, ilmenite 21.1%, and miscellaneous unidentified minerals 2.2%, was used. The rougher zircon flotation was carried out at a 2.5 pH value. The conditions of the rougher flotation are summarized in Table 1.

TABLE 1

| Parameter | Rougher Flotation Conditions | |
|---|---|---|
| | Conditioning | Flotation |
| Sulfuric Acid, pH | 2.5 | 2.5 |
| Starch, lbs/ton | 3.5 | |
| Sodium Fluoride, lbs/ton | 2.0 | |
| Percent Solids | 50 | 35 |
| Time, minutes | 3.0 | 4–6 |
| Armac C, lbs/ton | 0.1 | 0.20–0.35 |
| Stages of amine (Armac C) collector addition | | |
| 1st, lbs/ton | | 0.1 |
| Subsequent, lbs/ton | | 0.05 |
| Cell rpm | 1,500 | 1,500 |

The zircon froth product was put back into the same flotation cell and refloated (cleaner flotation) at pH 2.5 with no collector addition. The froth was conditioned for one minute (no air) to break loose any entrapped ilmenite and rutile particles. The sink product from the cleaner flotation was joined with a new quantity of feed. The zircon concentrate (final froth product) was removed.

The conditions of the cleaner flotation are summarized in Table 2.

TABLE 2

| Cleaner Flotation Conditions | | |
|---|---|---|
| Parameter | Conditioning | Flotation |
| Sulfuric Acid, pH | 2.5 | 2.5 |
| % Solids | 15 | 15 |
| Reagent Addition | None | None |
| Time, minutes | 1.0 | 2.0–2.5 |
| Cell rpm | 1,500 | 1,200 |

The sink product from the rougher flotation was then put in a 500 gram cell and the pH was raised to 10.0 using sodium hydroxide for quartz flotation. The material in the cell was conditioned for 30 seconds after each addition of Armac C and the quartz was floated. The conditions which were used for the quartz flotation are summarized in Table 3.

TABLE 3

| Quartz Flotation Conditions | | |
|---|---|---|
| Parameter | Conditioning | Flotation |
| Sodium Hydroxide, pH | 10.0 | 10.0 |
| Percent Solids | 25 | 25 |
| Time | 30 seconds | 4.0–4.5 minutes |
| Armac C, lbs/ton | 0.20–0.25 | |
| Stages of amine (Armac C) collector addition | | |
| 1st two, lbs/ton | 0.1 | |
| Subsequent, lbs/ton | 0.05 | |
| Cell rpm | 1,500 | 1,500 |

The weight splits from the locked cycle flotation scheme are shown in FIG. 1.

Microscopic minerals point count analyses were carried out on the flotation products and the following approximate analyses were obtained. The quartz float product contained about 95% quartz. The zircon float product contained about 72% zircon and the rutile/ilmenite sink product contained about 97% of rutile and ilmenite.

We claim:

1. A method for separating a mixture of minerals comprising at least zircon, ilmenite and rutile which comprises:

adding an acid solution to the mixture to acidify to a pH of between about 2.0 and 6.0;

adding starch to the mixture to depress the ilmenite and the rutile;

adding a source of fluoride ions to the mixture to provide a negative surface charge on the zircon surface to activate the zircon;

adding an amine cationic collector to the mixture to float the activated zircon;

subjecting the mixture containing the added acid solution, the fluoride ions, the starch and the cationic collector, to froth flotation; and withdrawing a float product comprising the zicron and a sink product comprising the ilmenite and rutile.

2. The method according to claim 1, wherein the mixture of minerals further comprises aluminum silicate minerals wherein the adding of fluoride ions activates the aluminum silicate minerals and the amine cationic collector floats the activated aluminum silicate minerals, the float product further comprises the aluminum silicate minerals.

3. The method according to claim 2 wherein the mixture is acidified to a pH of between about 2.0 and 3.0.

4. The method according to claim 1 wherein the acid solution comprises $H_2SO_4$.

5. The method according to claim 1 wherein the fluoride ions are obtained from at least one member selected from the group consisting of NaF, HF and $Na_2SiF_6$.

6. The method according to claim 5 wherein the source of fluoride is NaF.

7. The method according to claim 1 wherein the amine collector is coco amine having the formula $RNH_2$ wherein R is $C_6$–$C_{18}$ with 55% $C_{12}$.

8. The method of claim 1 further comprising the step of adding bentonite clay to remove the amine collector from the zircon.

9. The method of claim 1 wherein the starch is corn starch.

10. The method of claim 9 wherein the starch is prepared by mixing the starch in water to form a slurry and heating the slurry to a temperature for disrupting bonding of the molecules of the starch.

11. The method according to claim 1 further comprising before the step of adding an acid solution, the step of adding water to the mixture and the step of processing the particles of the mixture such that the particle sizes of the minerals are suitable for flotation.

12. The method of claim 1 wherein the mixture of minerals further comprises quartz and the adding of the starch depresses the quartz so that the sink product further comprises the quartz.

13. The method of claim 12 further comprising adding NaOH for increasing the pH after the step of subjecting the mixture to flotation and subjecting the sink product to a second froth flotation and withdrawing a second float product comprising quartz and a second sink product comprising the ilmenite and rutile.

14. The method of claim 1 further comprising adding a second cationic amine collector to the float product and subjecting the added second cationic amine collector and the float product to a cleaner froth flotation, and withdrawing a cleaned float product.

* * * * *